US008845767B2

(12) United States Patent
McRobbie et al.

(10) Patent No.: US 8,845,767 B2
(45) Date of Patent: Sep. 30, 2014

(54) METHODS OF TREATING COAL TO IMPROVE COMBUSTION AND REDUCE CARBON CONTENT OF FLY ASH

(75) Inventors: Ian McRobbie, Ellesmere Port (GB); Alan Ross, Ellesmere Port (GB); Victoria Pellegrini, Ellesmere Port (GB); James Barker, Ellesmere Port (GB); Katherine Le Manquais, Ellesmere Port (GB); Colin Snape, Nottingham (GB)

(73) Assignee: Innospec Limited (GB)

( * ) Notice: Subject to any disclaimer, the term of this patent is extended or adjusted under 35 U.S.C. 154(b) by 483 days.

(21) Appl. No.: 13/201,752

(22) PCT Filed: Feb. 12, 2010

(86) PCT No.: PCT/GB2010/050235

§ 371 (c)(1), (2), (4) Date: Oct. 25, 2011

(87) PCT Pub. No.: WO2010/092401

PCT Pub. Date: Aug. 19, 2010

(65) Prior Publication Data

US 2012/0124893 A1 May 24, 2012

(30) Foreign Application Priority Data

Feb. 16, 2009 (GB) ..... 0902517.2

(51) Int. Cl.

| | |
|---|---|
| ***C10L 5/00*** | (2006.01) |
| ***C10L 9/10*** | (2006.01) |
| ***C10L 10/00*** | (2006.01) |
| ***C10L 10/02*** | (2006.01) |
| *C10L 1/188* | (2006.01) |
| *C10L 1/24* | (2006.01) |
| *C10L 1/198* | (2006.01) |

(52) U.S. Cl.

CPC ..... *C10L 9/10* (2013.01); *C10L 1/1881* (2013.01); *C10L 1/2437* (2013.01); *C10L 1/1981* (2013.01); *C10L 10/00* (2013.01); *C10L 10/02* (2013.01)

USPC ..... 44/620; 44/627; 44/641

(58) Field of Classification Search

CPC ..... C10L 9/00; C10L 9/02; C10L 9/10; C10L 10/04; C10L 10/00; C10L 10/02

USPC ..... 44/608, 620, 627, 641

See application file for complete search history.

(56) References Cited

U.S. PATENT DOCUMENTS

| | | | | |
|---|---|---|---|---|
| 3,332,755 | A * | 7/1967 | Kukin | 44/603 |
| 4,098,584 | A | 7/1978 | Kindig et al. | |
| 4,192,787 | A | 3/1980 | Salmon | |
| 4,536,372 | A | 8/1985 | Burgess et al. | |
| 4,831,942 | A | 5/1989 | Morimoto et al. | |
| 4,968,324 | A | 11/1990 | Franke et al. | |
| 4,979,447 | A | 12/1990 | Farrar | |
| 5,001,994 | A | 3/1991 | Morimoto et al. | |
| 6,096,104 | A | 8/2000 | Van den Neste et al. | |
| 7,229,482 | B2 * | 6/2007 | May | 44/354 |
| 2008/0296202 | A1 | 12/2008 | Sneddon et al. | |

FOREIGN PATENT DOCUMENTS

| | | | |
|---|---|---|---|
| EP | 0 112 219 | A1 | 6/1984 |
| EP | 1 500 692 | A1 | 1/2005 |
| EP | 1498470 | A1 | 1/2005 |
| EP | 1 602 708 | A2 | 12/2005 |
| EP | 1612256 | A1 | 1/2006 |
| FR | 2495180 | A1 | 6/1982 |
| GB | 2091291 | A | 7/1982 |
| JP | 61-246291 | | 11/1986 |
| JP | 62-190288 | A | 8/1987 |
| JP | 62-190289 | A | 8/1987 |
| JP | 02160899 | A * | 6/1990 |
| JP | 3-188934 | A | 8/1991 |
| WO | 2007076052 | A2 | 7/2007 |
| WO | 2008020169 | A2 | 2/2008 |
| WO | 2008073017 | A1 | 6/2008 |

OTHER PUBLICATIONS

International Preliminary Report on Patentability, dated Aug. 16, 2011, from Parent PCT/GB2010/050235 filed on Feb. 12, 2010 from Parent PCT/GB/2009/02517.2, filed on Feb. 16, 2009.

International Search Report, dated Jul. 6, 2010, from Parent PCT/GB2010/050235 filed on Feb. 12, 2010 from Parent PCT/GB/2009/02517.2, filed on Feb. 16, 2009.

Written Opinion of the International Searching Authority, dated Jul. 6, 2010, from Parent PCT/GB2010/050235 filed on Feb. 12, 2010, from Parent PCT/GB/2009/02517.2, filed on Feb. 16, 2009.

Search Report from Parent GB0902517.2, filed on Feb. 16, 2009.

International Search Report dated Jun. 7, 2010 for PCT/GB10/50235.

* cited by examiner

*Primary Examiner* — Cephia D Toomer

(74) *Attorney, Agent, or Firm* — Burns & Levinson LLP; Janine M. Susan

(57) ABSTRACT

An iron salt of an organic acid, selected from formic acid, carboxylic acids having (3) or more carbon atoms and sulphonic acids, is used to reduce the carbon content of the fly ash, when coal is combusted.

23 Claims, No Drawings

METHODS OF TREATING COAL TO IMPROVE COMBUSTION AND REDUCE CARBON CONTENT OF FLY ASH

CROSS-REFERENCE TO RELATED APPLICATIONS

This application is a U.S. national stage application under 35 U.S.C. 371 of co-pending International Application No. PCT/GB10/50235 filed Feb. 12, 2010 and entitled "IMPROVEMENTS IN OR RELATING TO THE COMBUSTION OF COAL", which in turn claims priority to Great Britain Patent Application No. 0902517.2 filed Feb. 16, 2009, both of which are incorporated by reference herein in their entirety for all purposes.

This invention relates to a method of improving the combustion of coal; and to the use of an additive in achieving such an improvement. More specifically, the invention relates to a method, and the use of an additive, for improving the combustion of coal, so that the residual carbon content of the fly ash is reduced.

By fly ash herein we mean the total residue from combustion, including siliceous materials, and carbon.

A reduction in the proportion of the carbon mass may also lead to a reduction in the mass of fly ash; so in some embodiments of the invention the benefit may be a reduction in the proportion of carbon in the fly ash and a reduction in the mass of fly ash produced when combusting coal, on a like for like basis, except for the presence/absence of the additive composition.

Carbon in fly ash results from the incomplete combustion of coal. Fly ash is a waste product which may have a value, depending on its quality. Good grades of fly ash, low in carbon content, can be used in concrete as a filler, or as an active component of the concrete; it has pozzolanic activity when it is finely divided and is in the presence of water. It may replace Portland cement in concrete, wholly or in part. It can increase the durability and workability of concrete, reduce its permeability and give cost savings. Poor grades, higher in carbon content, go to landfill. Typically, fly ash must contain less than 6% carbon, if it is to be of use as a component of cement. Fly ash of greater than 6% carbon goes to landfill, with additional costs and environmental consequences.

Also, low carbon fly ash is easier to dispose of than high carbon fly ash, and is more easily captured by electrostatic precipitators that are often used to control particulate emissions.

In coal furnaces, several methods are known to reduce carbon in fly ash. In one prior solution, the amount of air injected into the combustion chamber is increased. While this method reduces the amount of carbon in fly ash, it typically results in an undesirable increase in $NO_x$ emissions.

It is also known to reduce carbon in fly ash by adding amounts of magnesium or calcium to the coal or in the combustion chamber. The concentration of such metals that must be added in order to be effective is very high. Unfortunately, large amounts of calcium or magnesium can cause other problems in a system such as fouling.

It is also known, from EP 1498470 A, to use a manganese additive to reduce the amount of carbon in fly ash but this technology is also limited in its application, and manganese has been associated with manganism, a neurotoxic condition.

U.S. Pat. No. 4,536,372 describes a method for the beneficiation of coal particles to reduce ash content, in which coal particles are chemically bonded and graft polymerised, using a water insoluble organic polymerisable monomer under peroxidation influence, to become hydrophobic. A water washing step is used to remove mineral ash in the coal and particularly iron pyrites, these components being hydrophilic. Thus a complex step is taken to remove iron pyrites, as part of the benefication process. In contrast the present invention involves the addition of an iron compound.

The drive to reduce emissions of nitrogen oxide gases (NOx) in combustion gases tends to mean conducting combustion at leaner oxygen levels than have previously been used, and results in incomplete combustion of coal, leading in turn to increased carbon content in fly ash.

Post treatments of fly ash to increase their economic value have been proposed, but are inherently inefficient.

An object of the present invention is to provide a method of combusting coal which improves its combustion; for example by achieving more complete combustion and/or producing fly ash lower in carbon content, when combusting coal on a like for like basis, except for the presence/absence of an additive composition, as defined herein.

We have found benefit in adding a particular class of iron-containing compound for this purpose.

In accordance with a first aspect of the present invention there is provided a method of burning coal, the method comprising the addition to the coal of an iron-containing compound, namely an iron salt of an organic acid, the organic acid being selected from formic acid, carboxylic acids having 3 or more carbon atoms, and sulphonic acids; the addition of the iron salt being into the combustion furnace or upstream thereof.

Preferably the iron salt of an organic acid reduces the carbon content of the fly ash when coal is combusted. Suitably the carbon content of fly ash may be reduced to below 10%, preferably below 8%, most preferably below 6%. In some preferred embodiments the carbon content of fly ash may be reduced to below 5%, or even to below 4% (wt carbon/wt fly ash).

Suitably the iron salt of an organic acid reduces the carbon content of the fly ash when coal is combusted, relative to the carbon content of fly ash when the coal is combusted in the absence of the iron salt of an organic acid.

Preferably the iron salt of an organic acid reduces the carbon content of the fly ash, when coal is combusted, by at least 5%, preferably by at least 10%, preferably by at least 15%, preferably by at least 20%, preferably by at least 25%, preferably by at least 30% (percentage reductions in the weight of carbon in fly ash, compared with the weight of carbon in fly ash in the absence of the iron salt of an organic acid).

In accordance with a second aspect of the present invention there is provided the use of an iron salt of an organic acid (as defined herein), to reduce the carbon content of the fly ash when coal is combusted.

In accordance with a third aspect of the present invention there is provided coal treated with an iron salt of an organic acid (as defined herein), to reduce the carbon content of the fly ash when coal is combusted.

In accordance with a fourth aspect of the present invention there is provided a process for treating coal to reduce the carbon content of the fly ash when the coal is combusted, wherein the coal is treated prior to or during combustion with an iron salt of an organic acid (as defined herein).

In accordance with a fifth aspect of the present invention there is provided an additive composition comprising an iron salt of an organic acid (as defined herein) and a dispersant.

The preferred features of the invention which follow relate equally to the method of the first aspect and to the use of the second aspect and to the coal of the third aspect and to the process of the fourth aspect and an additive composition of the fifth aspect.

The iron salt of an organic acid may have the Fe (II) or Fe (III) oxidation state.

Iron formate is a suitable iron salt, for use in the invention.

The organic acid is suitably a carboxylic acid having 3 or more carbon atoms. A preferred carboxylic acid may have at least 3 carbon atoms, preferably at least 6 carbon atoms, preferably at least 8 carbon atoms, preferably at least 10 carbon atoms, preferably at least 12 carbon atoms, preferably at least 14 carbon atoms, and most preferably at least 16 carbon atoms.

A suitable carboxylic acid may have up to 200 carbon atoms, preferably up to 100 carbon atoms, preferably up to 46 carbon atoms, preferably up to 36 carbon atoms, preferably up to 28 carbon atoms, preferably up to 24 carbon atoms, preferably up to 22 carbon atoms, and most preferably up to 20 carbon atoms, Examples of suitable carboxylic acids include formic acid, propionic acid, butyric acid, hexanoic acid, ethylhexanoic acid, lauric acid, palmitic acid, stearic acid, tall oil fatty acid, oleic acid, polycarboxylic acids such as dimer fatty acids, and alkyl succinic acids; and including mixtures thereof.

Suitable fatty acids include those having saturated or unsaturated carbon chains. Preferred fatty acids have saturated or mono-unsaturated carbon chains.

The organic acid is suitably a sulphonic acid. A preferred sulphonic acid is a compound is formula $R—S(=0)_2—OH$ where R is a hydrocarbon group. A preferred hydrocarbon group is a phenyl group substituted by one or more, preferably one to three, and preferably only one, alkyl group; preferably of carbon chain length from 1 to 32 carbon atoms, preferably from 4-28 carbon atoms, preferably from 8 to 24 carbon atoms.

The iron salt of an organic acid may be one which is overbased; that is to say an excess of iron-containing base is used to neutralise the organic acid.

In another embodiment the stoichiometric amount of iron-containing base is used to neutralise the organic acid.

The iron salt of an organic acid is preferably comprised within an additive composition. The additive composition may suitably comprise an iron salt of an organic acid in a solvent. The solvent is preferably water or an organic solvent, for example a hydrocarbon solvent, preferably a petroleum distillate, for example benzene substituted by 1 to 3 C(1-4) alkyl groups. Most preferred is xylene.

The iron salt of an organic acid may suitably comprise the iron salt of an organic acid, preferably in aqueous solution or in an organic solvent, in a fully dissolved form or in the form of a dispersion, for example a sol. Alternatively it may be provided as a powder.

Preferably an iron salt of an organic acid is added to the coal to provide a weight ratio (elemental iron to unadditised coal, % w/w) of at least 0.0001, preferably at least 0.001, preferably at least 0.005, preferably at least 0.01, more preferably at least 0.02, more preferably at least 0.04, most preferably at least 0.05.

Preferably an iron salt of an organic acid is added to the unadditised coal to provide a weight ratio (elemental iron to coal, % w/w) of up to 5, preferably up to 1, preferably up to 0.5, preferably up to 0.2.

The concentration of elemental iron present in iron salt(s) of an organic acid(s) in an additive composition is suitably in the range 1-600 g/kg (elemental iron/total weight of additive composition, including iron), preferably 2-400 g/kg, preferably 10-200 g/kg. When the additive composition is a liquid, as is preferred, it may instead be stated that the concentration of elemental iron in an additive composition is suitably in the range 1-600 g/l (elemental iron/total weight of additive composition, including iron), preferably 2-400 g/kg, preferably 10-200 g/l.

In the present invention one or more further metal-containing compounds may be added, in addition to an iron salt of an organic acid. Examples of said further metal-containing compounds include compounds of alkali metals, for example sodium or potassium, compounds of alkaline earth metals, for example calcium or magnesium, and of transition metals (by which we mean in this specification any element of the d-block of the periodic table), for example cerium, manganese, copper or zinc, and including additional compounds of iron (that is, compounds of iron other than iron salt(s) of organic acid(s).

In the present invention a said further metal-containing compound may for example be an oxide, a hydroxide, or a salt of a mineral or organic acid, for example a halide, especially a chloride or a bromide, a nitrate, a sulphate, a carbonate, a bicarbonate or a phosphate; or may be metallocenes.

In the present invention one or more ammonium compounds may be added, in addition to an iron salt of an organic acid. Examples of said ammonium compounds include ammonium hydroxide, and ammonium salts of mineral or organic acids, for example ammonium halides, especially ammonium chloride or ammonium bromide, ammonium nitrate, ammonium sulphate, ammonium carbonate, ammonium bicarbonate or an ammonium phosphate.

One of more of said further metal-containing compound may be used together with one or more ammonium compounds in addition to an iron salt of an organic acid. Furthermore mixed salts may be employed, for example employing mixed cationic species, preferably as defined above (for example ammonium sodium hydrogen phosphate), or mixed anionic species, or both.

Definitions herein of the weight of a given metal added to the coal particles are of the elemental metal (as distinct from a compound or complex). When there is more than one compound supplying a given metal, for the purpose of the definitions herein the weight to be considered is the total amount of the respective metal. As noted above in relation to iron definitions herein refer to the amount of iron provided by iron salt(s) of an organic acid(s) unless otherwise stated. In relation to the ammonium compounds the definitions herein denote the weight of the ammonium cation.

Suitably any further metal-containing are present in a total amount so as to provide a weight ratio, on unadditised coal of 0.0001 to 5%, preferably 0.001 to 1%, preferably 0.001 to 0.5%, preferably 0.01 to 0.2%, preferably 0.02 to 0.2%, preferably 0.04 to 0.2%, preferably 0.05 to 0.2%. In the case of said further iron-containing compounds the definitions do not include iron from iron salt(s) of an organic acid(s).

Suitably any ammonium compounds are present in a total amount so as to provide a weight ratio, on unadditised coal of 0.0001 to 5%, preferably 0.001 to 1%, preferably 0.001 to 0.5%, preferably 0.01 to 0.2%, preferably 0.02 to 0.2%, preferably 0.04 to 0.2%, preferably 0.05 to 0.2%.

Preferably the mass of iron added in the form of iron salt(s) of an organic acid(s) exceeds the summated mass of other metal(s) added, including iron from other iron compounds.

A dispersant may be present together with an iron salt of an organic acid (and is mandatory in the fifth embodiment).

A dispersant may be added to the coal particles to be, or being, combusted; good results have been obtained using an iron salt of an organic acid together with a dispersant. An iron salt of an organic acid and a dispersant could be provided together in one additive composition. However separate addition is not excluded.

Preferably a dispersant, when present, is present in a total amount so as to provide a weight ratio, on unadditised coal of 0.0001 to 5%, preferably 0.001 to 1%, preferably 0.001 to 0.5%, preferably 0.01 to 0.2%, preferably 0.02 to 0.2%, preferably 0.04 to 0.2%, preferably 0.05 to 0.2%.

Any suitable dispersant may be used.

Suitable dispersants can include alkoxylated fatty amines or derivatives thereof; alkoxylated polyamines; alkane sulphonic acids; aryl sulphonic acids; sarcosinates; ether carboxylic acids; phosphoric acid esters; carboxylic acids and derivatives thereof; alkylphenol-aldehyde resins; hydrophilic-lipophilic vinylic polymers; alkyl substituted phenol polyethylene polyamine formaldehyde resins; alkyl aryl compounds; alkoxylated amines and alcohols; imines; amides; zwitterionic compounds; fatty acid esters; lecithin and derivatives thereof; and derivatives of alkyl substituted succinic anhydride and succinamide.

Preferred dispersants for use in the present invention are molecules comprising alkyl groups, preferably alkyl groups having at least 8 carbon atoms and polar functional groups selected from, for example, sulphonic acid groups, phosphonic acid groups, carboxylic acid groups, amines, amides, imides, alcohols and esters. Compounds including aromatic moieties are also suitable. Regions of the molecule may, for example, be linked by a polyalkoxylene unit, carbonate groups, imine or amide groups.

Suitable compounds are polymeric or oligomeric compounds. Most suitable are polymeric or oligomeric compounds including a hydrophobic functionality and a hydrophilic functionality.

Suitable nitrogen-containing dispersants include the reaction product of a carboxylic acid-derived acylating agent and an amine or the reaction product of an amine with formaldehyde and an optionally substituted phenol.

Preferred dispersants include a phenol resin.

In one aspect the phenol resin is a compound of Formula I

Formula I

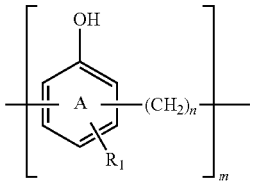

wherein m is at least 1; wherein n is at least 1; wherein the or each $R_1$ is selected from alkyl groups, aromatic groups and heterocycles, and wherein ring A is optionally further substituted with groups selected from —OH, hydrocarbyl groups, oxyhydrocarbyl groups, —CN, —$NO_2$, —$SO_3H$, —$SO_2H$, —COOH, —$COOR_4$, —$NH_2$, —$NHR_5$, —$SO_2NH_2$, —$SO_2$, —$NHR_6$, $CONH_2$, $CONHR_7$, SH and halogens; wherein each of $R_4$, $R_5$. $R_6$ and $R_7$ is independently selected from hydrocarbyl groups.

In one preferred aspect m is greater than 1. In one preferred aspect, m is 1 to 50, such as 1 to 40, 5 to 30, or 10 to 20. In a preferred aspect, m is 11 to 15.

n may be any suitable integer. For example n may be from 1 to 10 such as 1 to 8, 1 to 5 or 1, 2 or 3. Preferably n is 1.

$R_1$ may be a linear or branched alkyl group.

In one aspect, preferably $R_1$ is a $C_1$-$C_{200}$ alkyl group, preferably a $C_1$-$C_{150}$ alkyl group, preferably a $C_{10}$-$C_{100}$ alkyl group, preferably a $C_1$-$C_{80}$ alkyl group, preferably a $C_1$-$C_{50}$ alkyl group, preferably a $C_1$-$C_{20}$ alkyl group, preferably a $C_5$-$C_{20}$ alkyl group, preferably a $C_5$-$C_{15}$ alkyl group, preferably a $C_6$-$C_{12}$ alkyl group, preferably a $C_7$-$C_{11}$ alkyl group, preferably a $C_8$-$C_{10}$ alkyl group, more preferably a $C_9$ alkyl group.

In one aspect, $R_1$ is a branched alkyl group, preferably a $C_{3-6}$ branched alkyl group, for example t-butyl.

In one aspect, $R_1$ is a straight chain alkyl group.

In one preferred aspect $R_1$ is para substituted relative to the OH group.

In one preferred aspect the $(CH_2)_n$ group is ortho substituted relative to the OH group.

It will appreciated by one skilled in the art that the each of the "units" of Formula I may contain one or more further substituents. The "units" of Formula I independently of each other may be optionally substituted. As discussed herein ring A is optionally further substituted with groups selected from —OH, hydrocarbyl groups, oxyhydrocarbyl groups, —CN, —$NO_2$, —$SO_3H$, —$SO_2H$, —COOH, —$COOR_4$, —$NH_2$, —$NHR_5$, —$SO_2NH_2$, —$SO_2$, —$NHR_6$, $CONH_2$, $CONHR_7$, SH and halogens; wherein each of $R_4$, $R_5$. $R_6$ and $R_7$ is independently selected from hydrocarbyl groups. In a preferred aspect at least one of the "units" is unsubstituted. In a further preferred aspect each of the "units" is unsubstituted.

Preferably the coal when combusted is in the form of particles, of mean size in the range 1-1000 μm, preferably 10-170 μm, preferably 30-110 μm, as measured by a sieve.

When the iron salt of an organic acid is added upstream of the combustion furnace it may be added to the coal upstream of the combustion chamber, for example to the as-mined coal or to an intermediate broken or crushed form, between as-mined and pulverized; or to a pulveriser mill in which coal is ground into coal particles; or to a feed line through which the particles are conveyed to the furnace.

When the iron compound is added into the combustion furnace it is preferably added during the first half of the combustion process, more preferably substantially at the start of the combustion process.

The iron salt of an organic acid composition containing the additive composition may be injected into the process, for example by a positive displacement pump, or screw device, or spray device.

The invention is applicable to any coal, including so-called low rank coal (for example lignite—often being high in sulphur—and sub-bituminous—often high in moisture) and high rank coal (for example bituminous and anthracite).

The invention is applicable to any combustion system, for example pulverized fuel systems, fluidised beds or fixed beds, for example stokers.

The invention will now be further described, by way of illustration only, with reference to the examples which follow.

In these examples coal burnout was analysed, in terms of the proportion of a given sample which combusted, in a given time. This was assessed by Thermo-Gravimetric Analysis (TGA) using a Texas Instruments TGA analyser model Q5000. The given sample of coal particles, having a known mean particle size, all in the range 35-150 μm, was warmed to 50° C. and held for a short period, 2-3 minutes, to remove moisture; raised to 1050-1100° C. at a rate of 150° C./minute under a nitrogen atmosphere to devolatilise the sample; then allowed to cool to 525° C. After about 20 minutes from the start of the procedure the temperature of 525° C. was reached, and at that temperature air was admitted and the fuel ignited. Combustion took place for a further 80 minutes. The temperature was held at 525° C. for the duration of the combustion period.

The weight loss profile measured by TGA is typically as follows: (1) there is an initial small weight loss due to loss of water, followed by (2) a substantial weight loss due to loss of volatiles, as the temperature rises to 1050-1100° C. and is allowed to cool to 525° C., over a period of about 10 minutes, followed by (3) progressive loss of weight, due to combustion of the carbon in the coal. The weight loss during phase (3) is parabolic and towards the end of the combustion period the weight loss becomes almost complete, and asymptotic. In practical terms substantially all of the carbon can be burnt from any sample if the combustion mix is suitable and the combustion time is long enough. In a typical sample total carbon combustion can be expected after about 80-100 minutes of combustion, under the conditions chosen. Assessing the point at which substantially complete combustion was achieved is very difficult due to the asymptotic weight loss at the end of combustion. Therefore to provide useful results the measurements made were for the time to achieve 90% weight loss, as measured from that time when combustion commenced; that is, to measure 90% loss of the weight of the carbon. Samples having a lower burnout time to 90% demonstrate faster combustion and hence are expected to burn more completely in a coal fired power station and have less residual carbon in fly ash.

In all of the following examples amounts of additive are expressed as weight elemental metal as a percentage of weight of unadditised and untreated coal.

In Tables 1, 2, 3, 4 and 5 below the weight stated for Fe, Ca, Ce and Mg is elemental weight, of Fe, Ca, Ce and Mg, respectively. Iron tallate is believed to be iron (III) tallate.

EXAMPLE SET A

The TGA technique was used to assess the effect of the addition of a series of additives, all comprising an iron salt of an organic acid, at different rates, on the burning of a sample of an anthracite coal, ATC No 3. The properties of the ATC No 3 coal were: Moisture, 6-10%; Volatiles, 23.4%; Ash, 16.9%; Sulphur, 0.6%; Heating Value, 24.87 MJ/kg gross.

The iron salt comprised overbased iron tallate in an aromatic solvent. The salts of calcium, magnesium and cerium each consisted of salts of a mixture of $C_{10-24}$ fatty acids, alkyl benzene sulphonic acids and $C_{6-10}$ organic acids in an aromatic solvent. Additive A is a dispersant comprising a nonyl phenol formaldehyde resin having Mn 2680 in hydrocarbon solvent.

The results are shown in Table 1. A benefit is evident at 90% combustion. The results show a benefit from the use of the iron salts of the fatty acids and a further benefit from the use of the iron salts in combination with other metal salts or dispersant.

TABLE 1

Burnout time (BT) to 90% for ATC No 3 Coal (38-53 μm)

| % W/W Metal added | | | | | | |
|---|---|---|---|---|---|---|
| % Fe | % Ca | % Ce | % Mg | % Additive A | BT @90% (mins) | % improvement |
| | | | | | 42.8 | (base value) |
| 0.07 | | | | | 36.0 | 15.89 |
| 0.12 | | | | | 31.7 | 25.93 |
| 0.20 | | | | | 30.1 | 29.67 |
| 0.13 | | | | 0.05 | 20.0 | 53.27 |

TABLE 1-continued

Burnout time (BT) to 90% for ATC No 3 Coal (38-53 μm)

| % W/W Metal added | | | | | | |
|---|---|---|---|---|---|---|
| % Fe | % Ca | % Ce | % Mg | % Additive A | BT @90% (mins) | % improvement |
| 0.04 | 0.08 | | | | 25.1 | 41.36 |
| 0.07 | 0.04 | 0.02 | | | 21.7 | 49.30 |

EXAMPLE SET B

The TGA technique was used to assess the effect of the addition of a series of additives, all comprising overbased iron tallate, at different rates, on the burning of a different sample of ATC No 3. The properties of the ATC No 3 coal were the same as in Example Set A. The individual metal salts and dispersant were the same as in Example Set A.

The results are shown in Table 2. Again a benefit is evident at 90% combustion.

TABLE 2

Burnout time (BT) to 90% for ATC No 3 Coal (38-53 μm)

| % W/W Metal added | | | | | | |
|---|---|---|---|---|---|---|
| % Fe | % Ca | % Ce | % Mg | % Additive A | BT @90% (mins) | % improvement |
| | | | | | 33.5 | (base value) |
| 0.06 | | 0.02 | | | 22.3 | 33.43 |
| 0.06 | 0.03 | | | | 21.5 | 35.82 |
| 0.06 | | | | | 30.6 | 8.65 |
| 0.07 | | 0.02 | | | 22.1 | 34.03 |
| 0.07 | 0.04 | | | | 19.8 | 40.90 |
| 0.07 | | | | | 24.8 | 25.97 |
| 0.04 | | | 0.01 | | 26.6 | 20.60 |
| 0.03 | | | 0.03 | | 28.4 | 15.2 |

EXAMPLE SET C

The TGA technique was used to assess the effect of the addition of a series of additives, all comprising overbased iron tallate, at different rates, on the burning of a different sample of ATC No 3. The properties of the ATC No 3 coal were the same as in Example Set A except that the particle size was different (53-75 μm). The individual metal salts and dispersant were the same as in Example Set A with the addition of a copper compound, copper oxychloride). The results are shown in Table 3. Again a benefit is evident at 90% combustion.

TABLE 3

Burnout time (BT) to 90% for ATC No 3 Coal (53-75 μm)

| % W/W Metal added | | | | % | | | |
|---|---|---|---|---|---|---|---|
| % Fe | % Ca | % Ce | % Mg | Additive A | Copper oxychloride | BT @90% (mins) | % improvement |
| | | | | | | 51.20 | (base value) |
| 0.07 | 0.04 | 0.02 | | | 0.09 | 28.00 | 45.31 |
| 0.03 | 0.08 | | 0.01 | | 0.09 | 31.90 | 37.70 |
| 0.12 | | | | 0.05 | 0.09 | 21.50 | 58.01 |
| 0.05 | 0.03 | 0.02 | | | 0.33 | 23.00 | 55.08 |
| 0.02 | 0.06 | | 0.01 | | 0.33 | 23.70 | 53.71 |
| 0.08 | | | | 0.05 | 0.33 | 15.40 | 69.92 |

EXAMPLE SET D

The use of iron as an additive for different coals was studied in the same way as is described above in Example Set B. The iron compound was overbased iron tallate. The treat rate thereof, the coals and the results are set out in Table 4 below.

TABLE 4

| Material Tested | Burnout Time to 90% (mins) | % Improvement |
|---|---|---|
| Coal, Reitspruit – no additive | 37.0 | (base value) |
| Coal, Reitspruit + Fe (0.05% w/w) | 36.0 | 2.7% |
| Coal, Prokopijevskij – no additive | 43.0 | (base value) |
| Coal, Prokopijevskij + Fe (0.05% w/w) | 39.0 | 9.3% |
| Coal, Chang Yan – no additive | 23.0 | (base value) |
| Coal, Chang Yan + Fe (0.05% w/w) | 18.5 | 19.5% |

Prokopijevskij coal (from the Prokopyevsk province, of central Russia. Chang Yan coal (from China).

In each case an improvement was seen.

EXAMPLE SET E

The use of iron compounds as additives added to the ATC coal No. 3 of Example Set C, was studied in the same way as is described in Example Set A. The additives, their treat rates, and the results, are as stated in Table 5 below.

TABLE 5

| Iron compound | Amount of Fe added (% W/W) | Burnout Time to 90% (mins) | Burnout time Improvement (%) |
|---|---|---|---|
| — (coal only) | — | 34.0 | (base value) |
| Iron (III) formate | 0.29 | 29.5 | 13.2 |
| Iron (II) acetate (comparison) | 0.32 | 32.6 | 4.1 |
| Iron tallate (overbased) | 0.18 | 27.7 | 18.5 |

The invention claimed is:

1. A method of treating coal to reduce the carbon content of fly ash formed when the coal is combusted, comprising adding an iron salt of an organic acid selected from the group consisting of formic acid, carboxylic acids having 3 or more carbon atoms and sulphonic acids and further comprising adding a dispersant comprising a phenol resin.

2. The method according to claim 1, wherein the carboxylic acid is a $C_{12-24}$ carboxylic acid.

3. The method according to claim 1, wherein the iron salt of the organic acid is formed by neutralising the respective organic acid with an excess of a respective iron-containing base.

4. The method according to claim 1, wherein the iron salt of the organic acid comprises the iron salt of the organic acid in a fully dissolved form or in the form of a dispersion or a powder.

5. The method according to claim 1, wherein the iron salt of the organic acid is added to the coal to provide a weight ratio of elemental iron from the iron salt of the organic acid to unadditised coal, % w/w, of at least 0.0001.

6. The method according to claim 1, wherein the iron salt of the organic acid is added to the coal to provide a weight ratio of elemental iron from the iron salt of an organic acid to unadditised coal, % w/w, of up to 5.

7. The method according to claim 1, wherein the coal when combusted is in the form of particles of mean size in the range 1-1000 μm, wherein the iron salt of the organic acid is added to the coal particles in a combustion chamber; or is added upstream of a combustion chamber to the as-mined coal; or to an intermediate broken or crushed form, between as-mined and pulverized; or to a pulveriser mill in which coal is ground into coal particles; or to a feed line through which coal particles are conveyed to the furnace.

8. The method according to claim 1, wherein the dispersant is added in a total amount so as to provide a weight ratio, on unadditised coal, of 0.0001 to 5%.

9. The method according to claim 1, wherein the dispersant is selected from the group consisting of alkylphenol-aldehyde resins.

10. The method according to claim 1, further comprising adding one or more metal-containing compounds selected from the group consisting of compounds of alkali metals, compounds of alkaline earth metals and compounds of transition metals.

11. The method according to claim 1, further comprising adding one or more ammonium compounds.

12. The method according to claim 1, wherein the carbon content of fly ash is reduced to below 10%.

13. Treated coal wherein the coal is treated for reduction in the carbon content of fly ash formed when the coal is combusted with an iron salt of an organic acid selected from the group consisting of:

sulphonic acid, and as overbased carboxylic acid having 3 or more carbon atoms, and wherein the treated coal is further treated with a dispersant comprising a phenol resin.

14. The method according to claim 1, wherein the phenol resin is the reaction product of a phenol and an aldehyde.

15. The method according to claim 14, wherein the aldehyde is formaldehyde.

16. The method according to claim 1, wherein the addition of the iron-containing compound to the coal is upstream of a combustion furnace.

17. The method according to claim 1, wherein the addition of the iron-containing compound to the coal is into a combustion furnace.

18. The method according to claim 10, wherein the compounds of transition metals comprise compounds of iron.

19. Treated coal according to claim 13, wherein the dispersant is selected from the group consisting of alkylphenol-aldehyde resins.

20. Treated coal according to claim 13, wherein the phenol resin is the reaction product of a phenol and an aldehyde.

21. Treated coal according to claim 20, wherein the aldehyde is formaldehyde.

22. The method according to claim 1, wherein the phenol resin is a compound of Formula I:

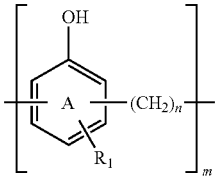

wherein m is at least 1; n is at least 1; the or each $R_1$ is selected from the group consisting of alkyl groups, aromatic groups and heterocycles; ring A is optionally further substituted with one or more groups selected from the group consisting of —OH, hydrocarbyl groups, oxyhydrocarbyl groups, —CN, —$NO_2$, —$SO_3H$, —$SO_2H$, —COOH, —$COOR_4$, —$NH_2$, —$NHR_5$, —$SO_2NH_2$, —$SO_2$, —$NHR_6$, —$CONH_2$, —$CONHR_7$, —SH and halogens; and each of $R_4$, $R_5$, $R_6$ and $R_7$ is independently selected from the group consisting of hydrocarbyl groups.

23. Treated coal according to claim 13, wherein the phenol resin is a compound of Formula I:

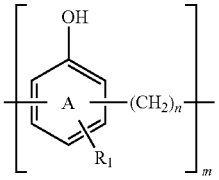

wherein m is at least 1; n is at least 1; the or each $R_1$ is selected from the group consisting of alkyl groups, aromatic groups and heterocycles; ring A is optionally further substituted with one or more groups selected from the group consisting of —OH, hydrocarbyl groups, oxyhydrocarbyl groups, —CN, —$NO_2$, —$SO_3H$, —$SO_2H$, —COOH, —$COOR_4$, —$NH_2$, —$NHR_5$, —$SO_2NH_2$, —$SO_2$, —$NHR_6$, —$CONHR_2$, —$CONHR_7$, —SH and halogens; and each of $R_4$, $R_5$, $R_6$ and $R_7$ is independently selected from the group consisting of hydrocarbyl groups.

* * * * *